US007296907B2

(12) United States Patent
Targetti

(10) Patent No.: US 7,296,907 B2
(45) Date of Patent: Nov. 20, 2007

(54) LIGHTING FIXTURE

(75) Inventor: Giampaolo Targetti, Florence (IT)

(73) Assignee: Targetti Sankey S.p.A., Florence (IT)

( * ) Notice: Subject to any disclaimer, the term of this patent is extended or adjusted under 35 U.S.C. 154(b) by 161 days.

(21) Appl. No.: 10/550,370

(22) PCT Filed: Sep. 7, 2004

(86) PCT No.: PCT/IT2004/000480

§ 371 (c)(1),
(2), (4) Date: Sep. 19, 2005

(87) PCT Pub. No.: WO2005/024297

PCT Pub. Date: Mar. 17, 2005

(65) Prior Publication Data

US 2006/0176705 A1 Aug. 10, 2006

(30) Foreign Application Priority Data

Sep. 10, 2003 (IT) ..... FI2003A0235

(51) Int. Cl.
*F21V 21/04* (2006.01)

(52) U.S. Cl. ..... 362/147; 362/145; 362/364; 362/365

(58) Field of Classification Search ..... 362/145, 362/147, 148, 150, 254, 364, 365, 640
See application file for complete search history.

(56) References Cited

U.S. PATENT DOCUMENTS

| | | | | |
|---|---|---|---|---|
| 5,045,984 | A | 9/1991 | Trowbridge et al. | 362/365 |
| 6,164,802 | A * | 12/2000 | Gromotka | 362/375 |
| 2003/0012017 | A1* | 1/2003 | Reggiani | 362/148 |

FOREIGN PATENT DOCUMENTS

| | | |
|---|---|---|
| EP | 0845633 | 6/1998 |
| FR | 2638815 | 11/1990 |

* cited by examiner

*Primary Examiner*—Laura Tso
(74) *Attorney, Agent, or Firm*—Pollack, P.C.

(57) ABSTRACT

A recessed lighting fixture with a device for quickly mounting or dismounting the lamp is disclosed. The device comprises an annular body having a front edge defining an aperture with dimensions generally greater than the diameter of the lamp. Flexible retaining members extend radially from the front edge at the aperture, suitable for holding the body at the lamp laterally. At least a pair of radial projections extend internally from the edge and define a span having a width generally smaller than the diameter of the lamp, such that the edge rests against the radial projections and is biased against them by the flexible retaining members.

7 Claims, 1 Drawing Sheet

LIGHTING FIXTURE

FIELD OF THE INVENTION

The present invention relates generally to lighting arrangements and, more particularly, to fixtures for lighting and the like.

BACKGROUND OF THE INVENTION

With conventional lighting fixtures intended to be recessed in support panels, such as those used to form a ceiling or partition wall, appropriate devices must often be provided to allow access to the lamp so as to facilitate its mounting to and detachment from the ceiling or wall. In some cases, rings are used for this purpose. Specifically, the rings are fastened by screws to a support structure on which the edge of the lamp rests. In other arrangements, elastic rings of the open type are inserted in a seat of the lamp to prevent the lamp from falling out. In this regard, two small adjacent arms are typically provided, which extend perpendicularly from the ring openings, and are adjusted in order to remove the lamp. Still other devices utilize elastic thread-like elements with internally projecting protuberances on which the edge of the lamp rests.

Although useful, these lighting arrangements are considered unattractive and, therefore, generally unacceptable for this purpose. Accordingly, a system is desired for rapid assembly and disassembly of a lamp in a recessed lighting fixture which not only meets traditional requirements of good service, but also has an aesthetically pleasing appearance.

OBJECTS AND SUMMARY OF THE INVENTION

Accordingly, it is an object of the present invention to provide a lighting fixture of the recessed type, that includes a system for rapid assembly and/or disassembly of a lamp so as to facilitate maintenance of the fixture, without impairing the fixture's appearance.

Another object of the present invention is to provide a recessed lighting fixture in which the lamp can be readily disassembled by applying light, eccentric pressure to a selected glass surface of the lamp without the necessity of removing a locking element.

A further object of the present invention is to provide a lighting fixture of the recessed type that can be easily assembled without tools.

According to one aspect of the present invention, a recessed lighting fixture is provided having a system for quick mounting and dismounting of a lamp. The fixture comprises: an annular body with a front edge defining an aperture having dimensions larger than the diameter of the lamp; a flexible retaining member extending radially from the edge at the aperture suitable for holding the body of the lamp laterally; and at least one pair of radial projections extending internally from the edge and defining a span having a width smaller than the diameter of the lamp.

In this manner, the lamp may be firmly locked in a desired position in the lighting fixture between the radial projections on which the fixture and its edge rests, with the flexible retaining member forcing it against the projections. Moreover, a relatively light amount of pressure applied eccentrically to a selected glass surface of the lamp is all that is needed to remove the lamp from the fixture. Conversely, with equally simple operation, i.e., slight tilting and pressure against the flexible retaining member, the lamp may be readily positioned in the fixture.

BRIEF DESCRIPTION OF THE DRAWINGS

A specific, illustrative lighting fixture, according to the present invention, is described below with reference to the following drawings, in which.

The same numerals are used throughout the drawing figures to designate similar elements. Still other objects and advantages of the present invention will become apparent from the following description of the preferred embodiments.

DETAILED DESCRIPTION OF THE PREFERRED EMBODIMENTS

Figure 1:
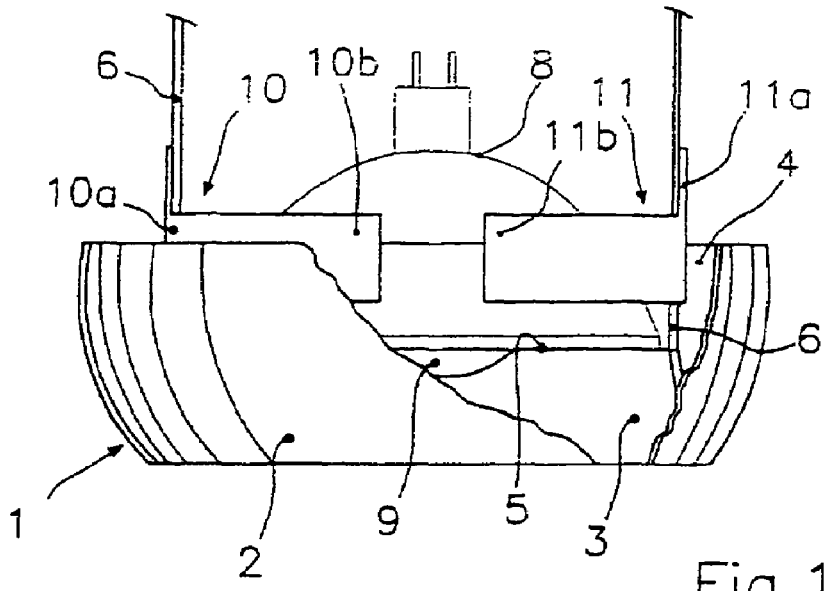
FIG. 1 is a side view of a device for quickly mounting and/or dismounting a lamp of a lighting fixture, according to one aspect of the present invention.
Figure 2:
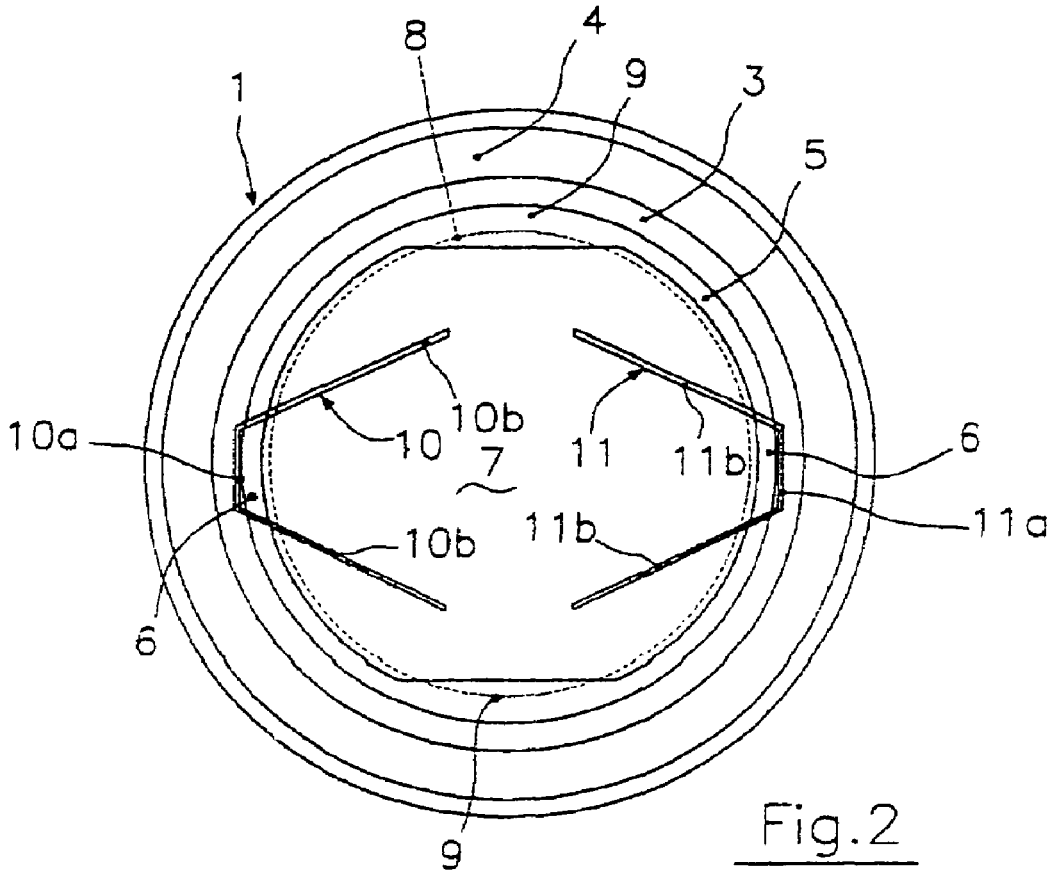
FIG. 2 is a plan view of the device shown in FIG. 1.

Referring now to the drawings and, more particularly, to FIGS. 1-2, there is shown generally a specific, illustrative, recessed-type lighting fixture with a device for mounting and/or dismounting a lamp, in accordance with various aspects of the present invention. According to one embodiment, shown generally in FIG. 1, the lighting fixture has an annular body 1 shaped so as to be housed in a seat of appropriate shape (not shown) that can be attached to the panel in which the fixture is to be recessed. Preferably, the annular body has a curved perimeter profile and the seat in which it is engaged is shaped correspondingly, so as to be mobile inside the seat and, more specifically, tiltable relative to an axis perpendicular to the panel in which the fixture rests. As illustrated, annular body 1 is formed by an external wall 2, substantially tapered and having a rounded profile, and an internal wall 3 extending coaxially from one end of the external wall and defining a circular groove 4 therewith. The internal wall has a front edge 5 that defines an aperture 7 in which a lamp 8 is placed, such being designated by a narrow line in FIG. 1.

A plurality diametrically opposed uprights 6, preferably at least one pair, are desirably provided which rise from front edge 5 with two projections 9 extending generally internally from the same edge, substantially at a 90° angle relative to the uprights. It is also desired that the diameter of aperture 7, defined by the front edge, be slightly larger than the diameter of lamp 8, while the span defined by projections 9 is slightly smaller than the lamp diameter.

It is preferred that the two uprights support two relatively flexible and substantially fork-shaped plate members or elements 10, 11. In particular, each plate element desirably comprises a base 10*a*, 11*a* and a pair of wide apart arms 10*b*. The respective bases 10*a*, 11*a* (of the plate elements 10, 11) are then joined to the uprights in any known manner, for example by screws, adhesives or clamping, while arms 10*b*, 11*b* extend diametrically towards one another.

Under normal operating conditions, according to one aspect of the present invention, the lamp rests with its front edge on the two radial projections and is pressed against them by wide apart arms 10*b*, 11*b* acting generally sideways thereon, such that the lamp is locked relatively firmly inside the annular body. This is shown, for instance, in FIG. 2 which illustrates, by a dotted line, a plan profile of the lamp as it rests on the radial projections.

When disassembly/dismounting of the lamp 8 is desired, it is sufficient to exert a relatively light amount of pressure eccentrically on and relative to a selected glass surface of the lamp, preferably in proximity to one of the radial projections, so as to disengage the lamp from the other radial projection and, thereby, cause its release from annular body. Notably in this regard, the diameter of the lamp is slightly smaller than the diameter of aperture 7 defined by edge 5.

Conversely, when the lamp is being mounted to the fixture, it is considered sufficient to perform the above-described operation in reverse, namely, by first inserting the lamp in the aperture, while making sure that the lamp is held at a slightly tilted orientation so that it can be readily engaged, first on one and then on the other of the two radial projections and, at the same time, exerting a slight amount of pressure to permit bending of arms 10*b*, 11*b* to a sufficient extent as to allow tilted insertion of the lamp.

In order to allow the lamp to be oriented in multiple directions, the uprights may also be formed with a pin engaged in a slotted guide. Arrangements of this general description are known by those skilled in the art and further description is considered unnecessary for purposes of illustrating the present invention. Alternatively or concurrently, the uprights may simply be formed integrally with the seat for housing the annular body such that the lamp is fixed.

Although the flexible laminar elements 10, 11 have been shown and described as having a fork-shaped configuration, other arrangements may be utilized, giving consideration to the purpose for which the present invention is intended. Generally speaking, the flexible retaining member can take any shape suitable for ensuring that the elastic forces applied to the sides of the lamp which can be readily overcome upon applying a moderate yet sufficient force, pressing the lamp against radial projections 9, and firmly holding the lamp in a selected position of use.

Various modifications and alterations may be appreciated based on a review of this disclosure. These changes and additions are intended to be within the scope and spirit of the invention as defined by the following claims.

What is claimed is:

1. A recessed type lighting fixture having a device for removably mounting a lamp, which comprises:

an annular body with a front edge defining an aperture having a diameter generally larger than that of the lamp;

a flexible retaining member extending radially from the edge at the aperture, suitable for holding the body of the lamp laterally; and at least one pair of radial projections extending internally from the edge and defining a span having a width generally smaller than the diameter of the lamp, such that the edge rests against the projections, the flexible retaining members biasing the edge against the projections.

2. The lighting fixture set forth in claim 1, wherein two diametrically opposed uprights extend from the edge to where the flexible retaining member is attached.

3. The lighting fixture set forth in claim 1, wherein the flexible retaining member comprises a pair of fork-shaped plate elements, each being formed by a base, integral to the edge, and a pair of widely spaced apart arms extending radially towards one another.

4. The lighting fixture set forth in claim 3, wherein the respective bases of the plate elements are attached to the uprights.

5. The lighting fixture set forth in claim 1, wherein the radial projections are positioned approximately 90° relative to the uprights.

6. The lighting fixture set forth in claim 1, wherein the annular body is suitable for engaging a corresponding seat integral to the panel, the fixture being recessed, and mounted so as to be oriented in the seat.

7. The lighting fixture set forth in claim 1, wherein the annular body is formed by an external wall and an internal wall extending coaxially from one end of the body and ending at the edge.

* * * * *